US011401729B2

(12) United States Patent
Cangemi et al.

(10) Patent No.: US 11,401,729 B2
(45) Date of Patent: Aug. 2, 2022

(54) SELF INFLATING CANOPY TENT

(71) Applicants: Nikolaos Cangemi, Laguna Hills, CA (US); Alexander Laetsch, Palos Verdes Estates, CA (US); Gregory Laetsch, Palos Verdes Estates, CA (US)

(72) Inventors: Nikolaos Cangemi, Laguna Hills, CA (US); Alexander Laetsch, Palos Verdes Estates, CA (US); Gregory Laetsch, Palos Verdes Estates, CA (US)

( * ) Notice: Subject to any disclaimer, the term of this patent is extended or adjusted under 35 U.S.C. 154(b) by 0 days.

(21) Appl. No.: 17/171,682

(22) Filed: Feb. 9, 2021

(65) Prior Publication Data

US 2021/0254363 A1 Aug. 19, 2021

Related U.S. Application Data

(60) Provisional application No. 62/976,134, filed on Feb. 13, 2020.

(51) Int. Cl.
*E04H 15/20* (2006.01)
*E04H 15/18* (2006.01)
*E04H 15/36* (2006.01)

(52) U.S. Cl.
CPC ..... *E04H 15/20* (2013.01); *E04H 15/18* (2013.01); *E04H 15/36* (2013.01); *E04H 2015/201* (2013.01); *E04H 2015/206* (2013.01)

(58) Field of Classification Search
CPC ..... E04H 15/20; E04H 2015/201; E04H 2015/206
See application file for complete search history.

(56) References Cited

U.S. PATENT DOCUMENTS 3,338,001 A * 8/1967 Fraser ..... E04H 15/20 52/2.21
3,785,395 A * 1/1974 Andreasson ..... F16K 15/20 137/223
3,995,653 A * 12/1976 Mackal ..... F16K 15/202 137/234
4,766,628 A * 8/1988 Walker ..... A47C 27/082 137/232
4,876,829 A * 10/1989 Mattick ..... E04H 15/20 135/125
5,394,897 A * 3/1995 Ritchey ..... E04H 15/18 52/79.8
5,746,243 A * 5/1998 Franke ..... F16K 15/145 137/231

(Continued)

FOREIGN PATENT DOCUMENTS

WO WO2012009534 A2 1/2012

*Primary Examiner* — Noah Chandler Hawk
(74) *Attorney, Agent, or Firm* — Fulwider Patton LLP

(57) ABSTRACT

A portable, inflatable canopy is disclosed having an inflatable support system including interconnected, intersecting arches over which a tarp is secured to form a dome structure that can be temporarily anchored to the ground as a respite for sun, heat, wind, and rain. The inflatable support system works with a battery powered fan to inflate the canopy quickly without outside power requirements, and the fan can also be used to quickly deflate the canopy. The use of all soft materials allows the canopy to be folded or rolled when deflated into a compact storage configuration without poles, rigid supports, or other cumbersome elements.

7 Claims, 8 Drawing Sheets

(56) References Cited

U.S. PATENT DOCUMENTS

| | | | | |
|---|---|---|---|---|
| 6,196,254 | B1 * | 3/2001 | Shaw | B60C 29/06 137/231 |
| 6,260,306 | B1 * | 7/2001 | Swetish | E04H 15/20 135/96 |
| 6,263,617 | B1 | 7/2001 | Turcot et al. | |
| 6,295,693 | B1 * | 10/2001 | Chou | F04D 29/626 141/66 |
| 6,708,451 | B1 * | 3/2004 | Gomes | E04H 15/20 52/2.25 |
| 8,499,500 | B2 * | 8/2013 | Lamke | E04H 15/20 52/2.17 |
| 9,861,901 | B1 | 1/2018 | Pierzynski et al. | |
| 10,179,998 | B1 * | 1/2019 | Ramp | E04H 15/20 |
| 10,184,263 | B2 * | 1/2019 | Yang | E04H 15/20 |
| 10,801,231 | B1 * | 10/2020 | Ensign | E04H 15/12 |
| 2002/0083653 | A1 * | 7/2002 | Hilbert | E04H 15/20 52/2.17 |
| 2005/0118046 | A1 | 6/2005 | Wang | |
| 2006/0162779 | A1 * | 7/2006 | Chaffee | F16K 15/202 137/223 |
| 2008/0196755 | A1 * | 8/2008 | Cheng | E04H 15/20 135/126 |
| 2008/0313969 | A1 | 12/2008 | Colucci et al. | |
| 2016/0305149 | A1 * | 10/2016 | Brezan | E04H 15/54 |

* cited by examiner

SELF INFLATING CANOPY TENT

This United States non-provisional patent application claims priority to U.S. Provisional Patent Application No. 62/976,134 filed Feb. 13, 2020, the content of which is fully incorporated herein by reference.

BACKGROUND

Transportable or "pop-up" canopies have become ubiquitous in many locations of leisure, including beaches, lakes, sporting events, and anywhere where relief from the sun or other elements is sought. Earlier canopies relied upon an arrangement of poles and truss elements to expand and form an enclosure to support an opaque tarp, but more recent versions of these devices have come to use inflatable components in place of rigid poles. The size of the devices mandate that separate, powered electrical pumps be brought to inflate the devices, but there are problems associated with the use of such pumps. It is difficult to mate the pump and the canopy support so that they connect properly, and outdoor environments often lack a power supply to properly energize the pump. The present invention seeks to overcome certain drawbacks of the prior inflatable canopy systems.

SUMMARY OF THE INVENTION

The present invention is an inflatable canopy tent that when deflated can be folded or rolled into a very compact configuration, and when inflated expands quickly and effortlessly into a double arched configuration suitable for providing shade, temporary shelter from rain, and comfort. The present invention includes a portable, rechargeable battery-powered fan system that can inflate the canopy tent without the need for an external AC power supply, eliminating the need for power outlets and electrical cords. The pump can be esthetically incorporated into the structure or be a separate device that is used to inflate the canopy and then stored until needed again. In a preferred embodiment, a connector specifically mates the pump outlet to the canopy valve via a specially designed coupling to facilitate connection and inflation. These, and other features of the invention will best be understood with reference to the accompanying drawings and the detailed description of the invention below.

DETAILED DESCRIPTION OF THE PREFERRED EMBODIMENTS

Figure 1:
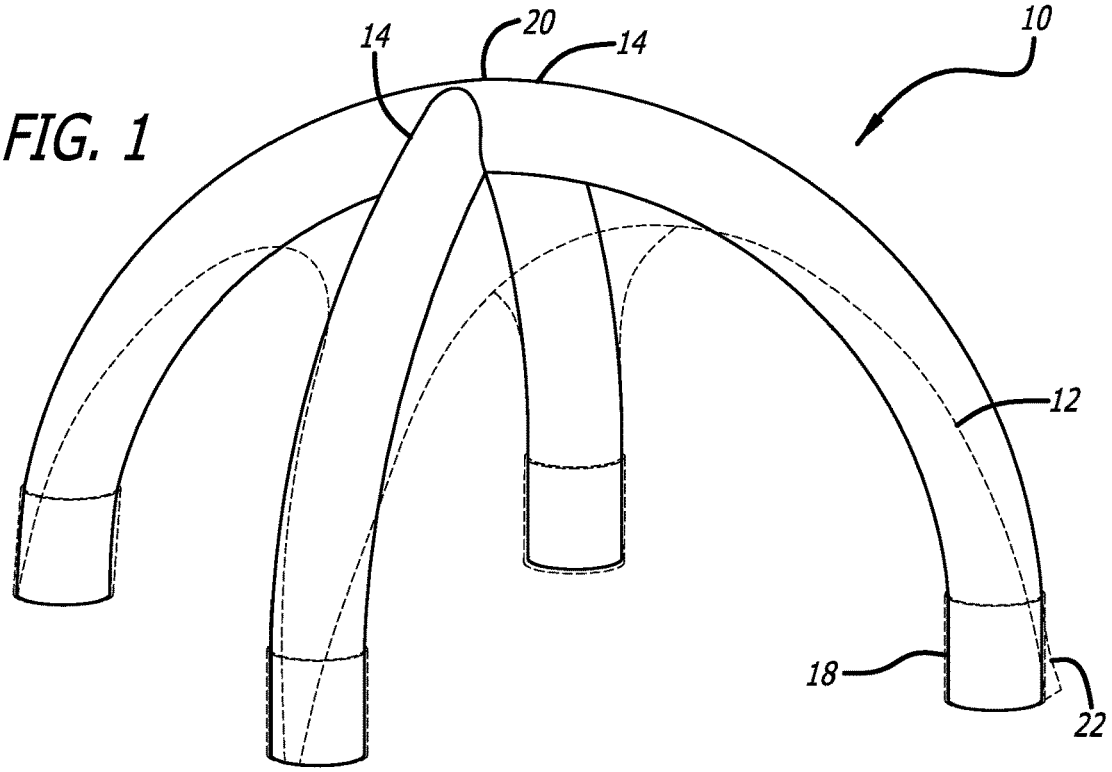
FIG. 1 an elevated, perspective view of a first embodiment of the present invention.
Figure 2:
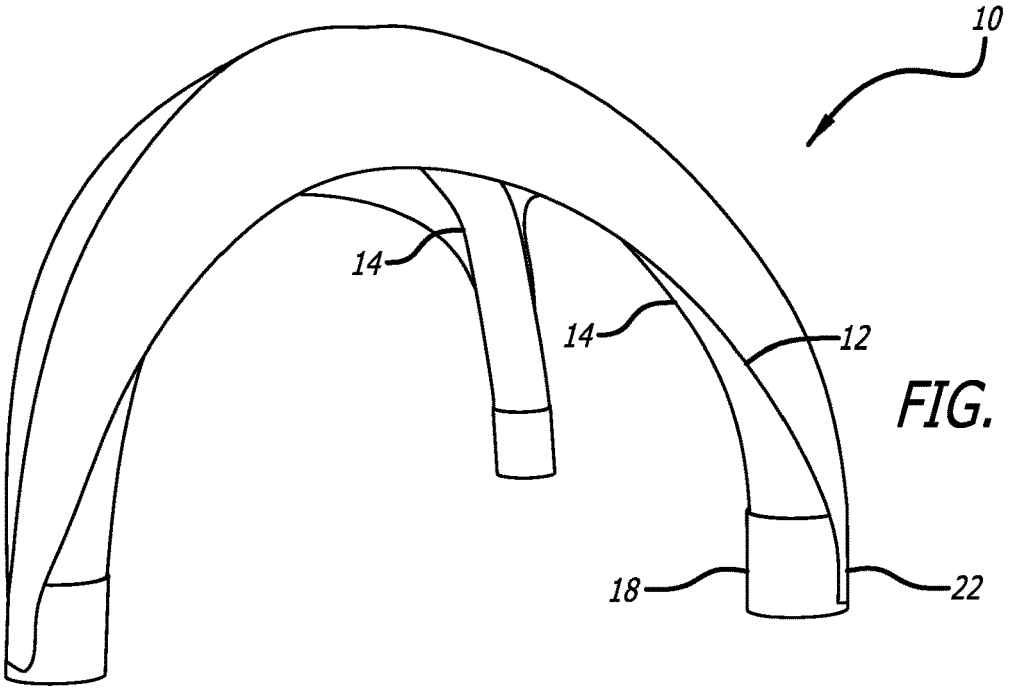
FIG. 2 is another elevated perspective view of the embodiment of FIG. 1.

FIGS. 1 and 2 illustrate an inflatable canopy 10 of the present invention comprising a tarp 12 supported by two intersecting and interconnected inflatable arches 14. The tarp 12 may preferably be a thin sheet of substantially opaque material made of a water resistant, flame retardant fabric or material that can block the rays of the sun and shelter occupants from rain without absorbing moisture and becoming weighted down. Such fabrics are preferably plastic in nature, such as polyester, and water repellant (hydrophobic), with sufficient robustness to last multiple seasons of use without tearing or fraying. The tarp 12 is preferably sewn along seams directly to the arches 14 in a permanent attachment so that the tarp 12 cannot blow off or become dislodged from the arches 14, although other forms of attachment are within the scope of the invention (e.g., hook and loop type fasteners). The tarp 12 has four extensions 16 that overlay the exterior sides of the four legs 18 of the arches 14, and form a dome-like configuration over the arches. When fully inflated, the tarp 12 is extended so as to be taut to prevent the tarp from flapping in the wind and creating unwanted noise to the occupants. The tarp 12 is preferably capable of receiving graphics and is colorable with multiple colors for aesthetics and promotional purposes such as advertisements or affiliation with clubs and/or organizations.

Figure 7:
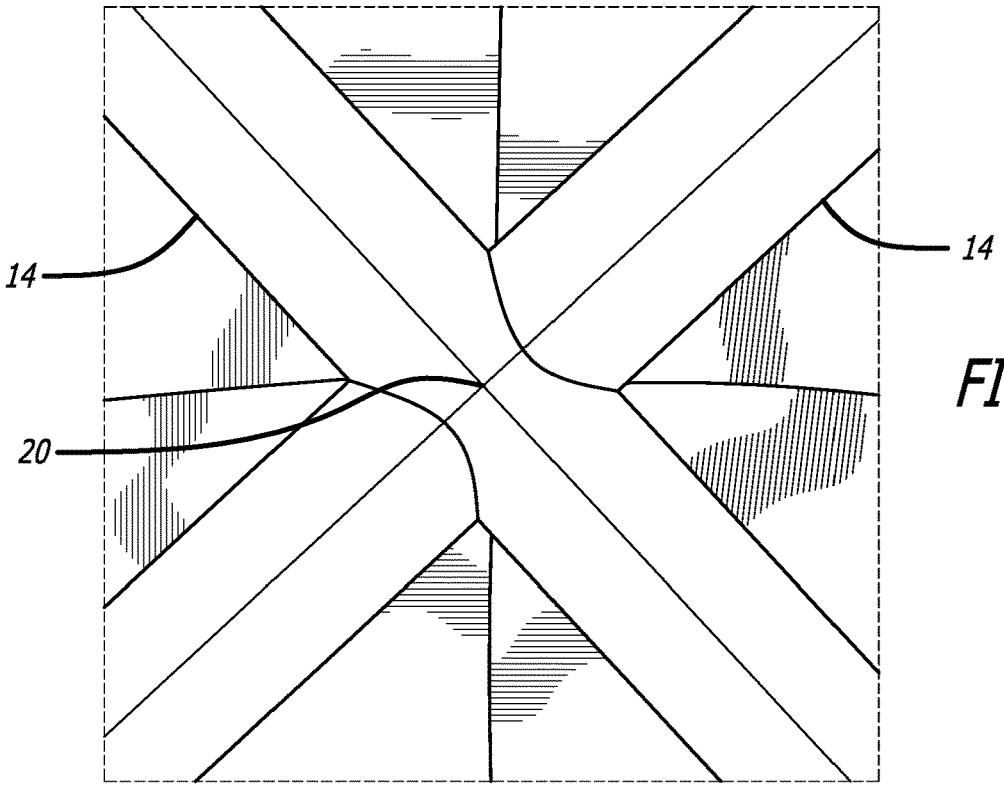
FIG. 7 is a bottom view of the intersection of the two inflatable arches at the point of intersection.

As stated above, the underlying support structure comprises two inflatable arches that connect at the apex 20 and extend perpendicular to one another. FIG. 7 illustrates the intersection of the two inflatable arches at the apex. The two arches 14 share a common airway such that a single point of inflation can inflate both arches simultaneously from a single inflation port or valve 33. Because the arches 14 are airtight, once inflated the arches stay inflated so a constant supply of flowing air is unnecessary with the present invention. In a preferred embodiment, the inflatable arches are fabricated of polyvinyl chloride (PVC) although other materials can be substituted within the scope of the present invention.

Figure 8:
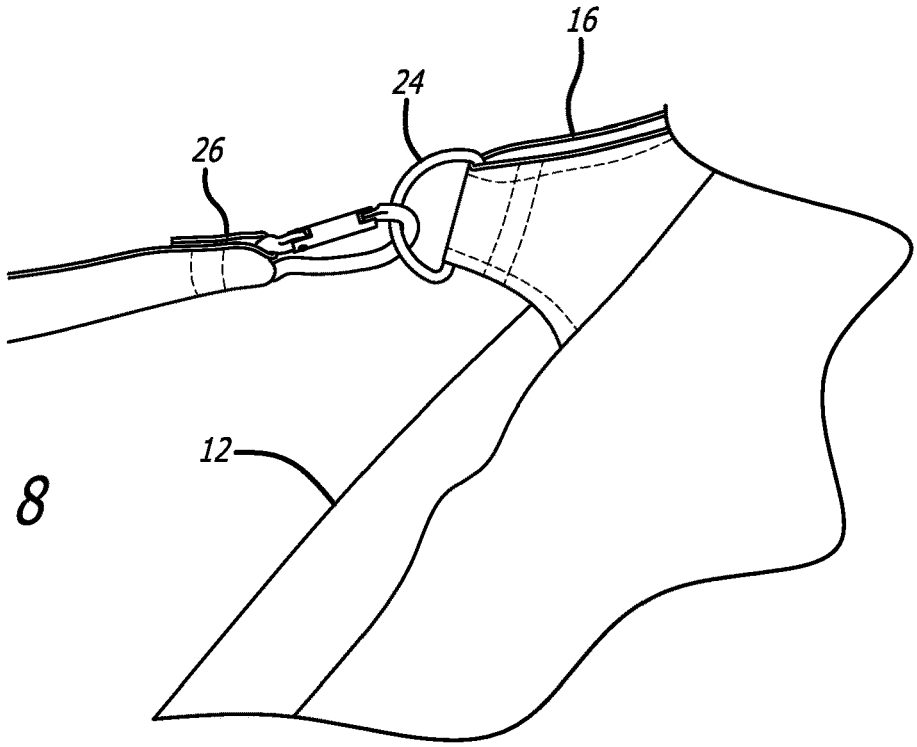
FIG. 8 is a side view of a D-ring and anchoring tie.

The legs 18 of the inflatable arches are separated by ninety degrees and cooperate to establish the dome skeleton that, along with the tarp 12, form a tent that provides shade and shelter. The tarp 12 may be sewn onto the arches along peripheral tabs 22, although other types of connections exist within the scope of the present invention. Sewing presents a more permanent connection that is always even, correct, and never needs adjusting (unlike tarps that are connected using less permanent means). The tarp may include anchors such as D-rings 24 or the like (FIG. 8) at the distal end of the extensions 16 that can be used to anchor the canopy 10 to the ground. Cables or straps 26 fastened to ground stakes loop through the D-rings 24 to secure the structure in place where wind or inclement weather could displace the canopy. In some embodiments, the tarp 12 may be comprised of multiple panels that are sewn together for a more robust covering.

Figure 3:
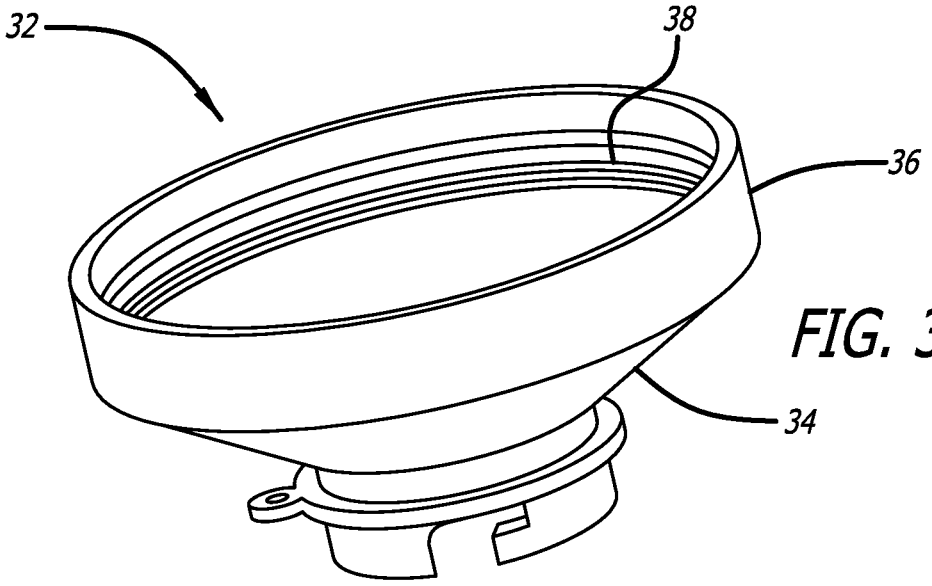
FIG. 3 is an enlarged, elevated perspective view of a fan adapter.
Figure 4:
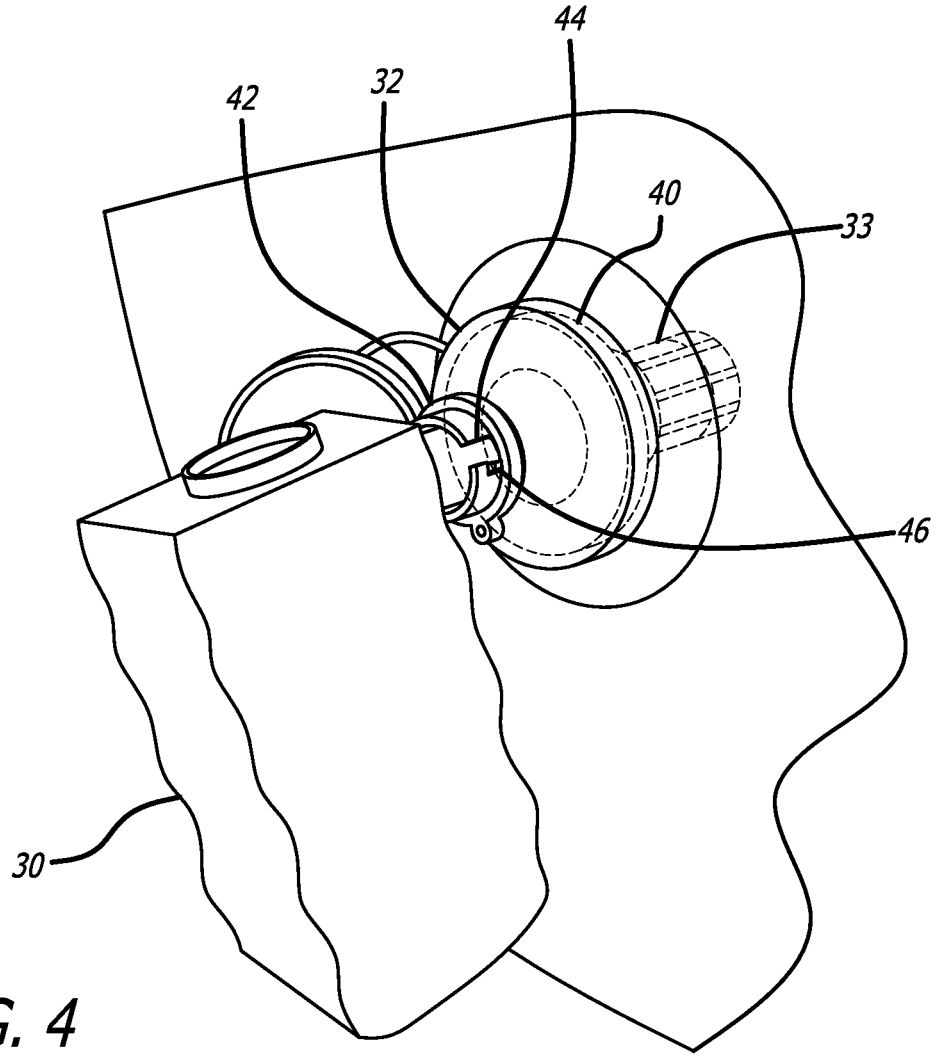
FIG. 4 is an elevated, perspective view of the portable fan coupled to the fan adapter.
Figure 5:
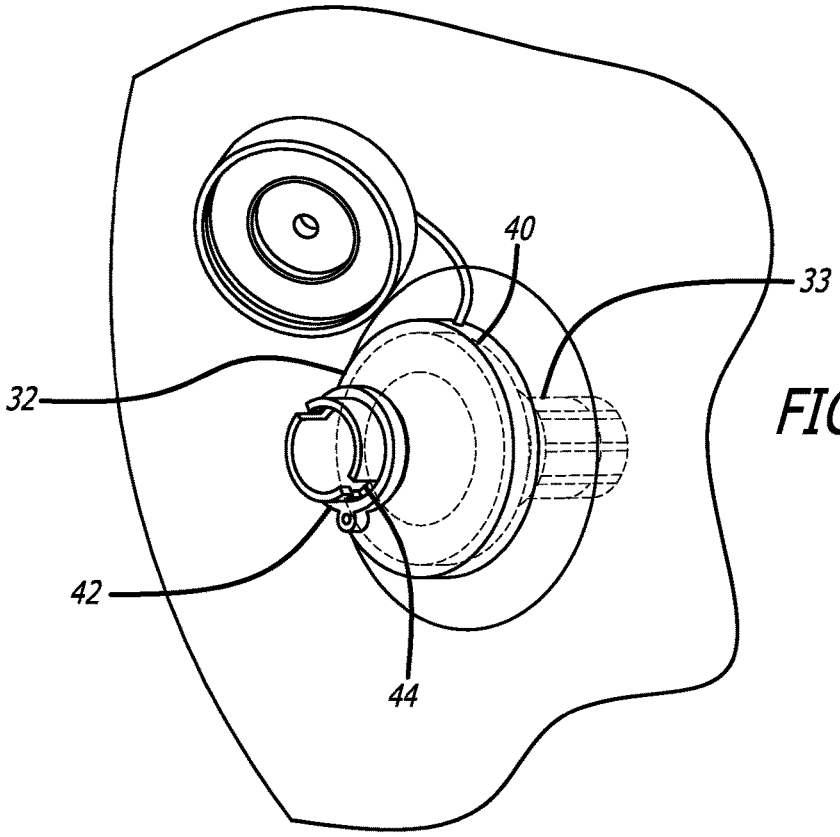
FIG. 5 is a front view of the adapter and closure element.

As seen in FIGS. 3-5, the present invention utilizes a battery powered air fan 30 to inflate the support structure when deployment is desired. The invention preferably utilizes a rechargeable lithium ion battery powered fan system for lightweight power and ease of mobility. Convenience is realized by the incorporation of a valve and adaptor system which allows for hands free operation during the inflation and deflation process, significantly increasing the ease with which the device is deployed. In a preferred embodiment, the fan is selected to fully inflate the canopy in under three (3) minutes. The adapter 32 couples to the canopy's valve 33 and comprises a conical body 34 terminating at an annular rim 36 with internal threads 38 that engage the valve's external threads 40 to provide an airtight and secure fit to the canopy's inflation system (FIG. 4). The valve preferably incorporates an internal flapper that uses the excess pressure to bias the flapper against the opening and resist leakage. The adapter 32 further comprises a flange 42 with a twist lock arrangement in the form of a slot 44 that receives a pin 46 on the fan 30 to rotationally and releasably lock the fan 30 to the adapter 32. This allows the unattended inflation of the canopy by the portable fan. The fan twist locks onto the adapter 32 and the fan 30 is turned on, forcing air out of the fan 30 through the adapter 32 and valve 33 to inflate the canopy 10. The canopy may include a built-in pocket or pouch to store the fan so as not to separated the fan from the canopy when not in use.

Figure 6:
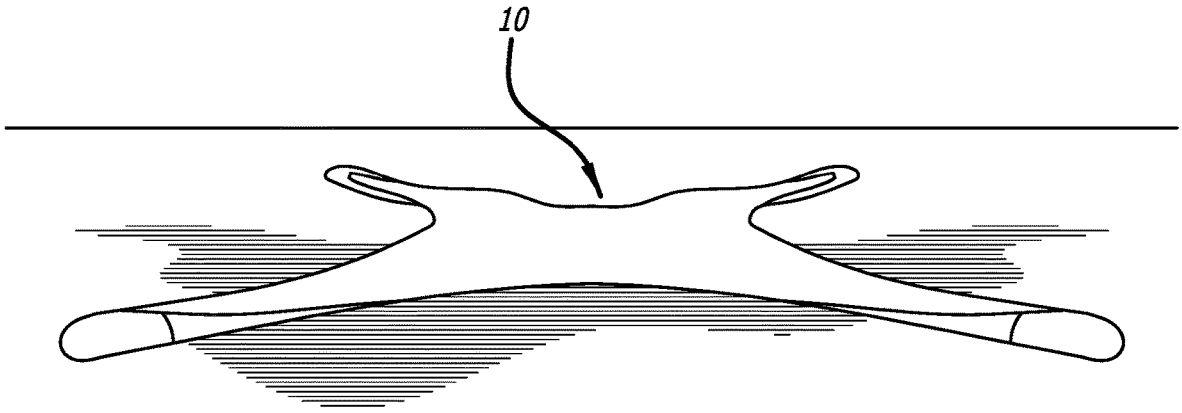
FIG. 6 is an elevated, perspective view of the embodiment of FIG. 1 in a deflated state.
Figure 9:
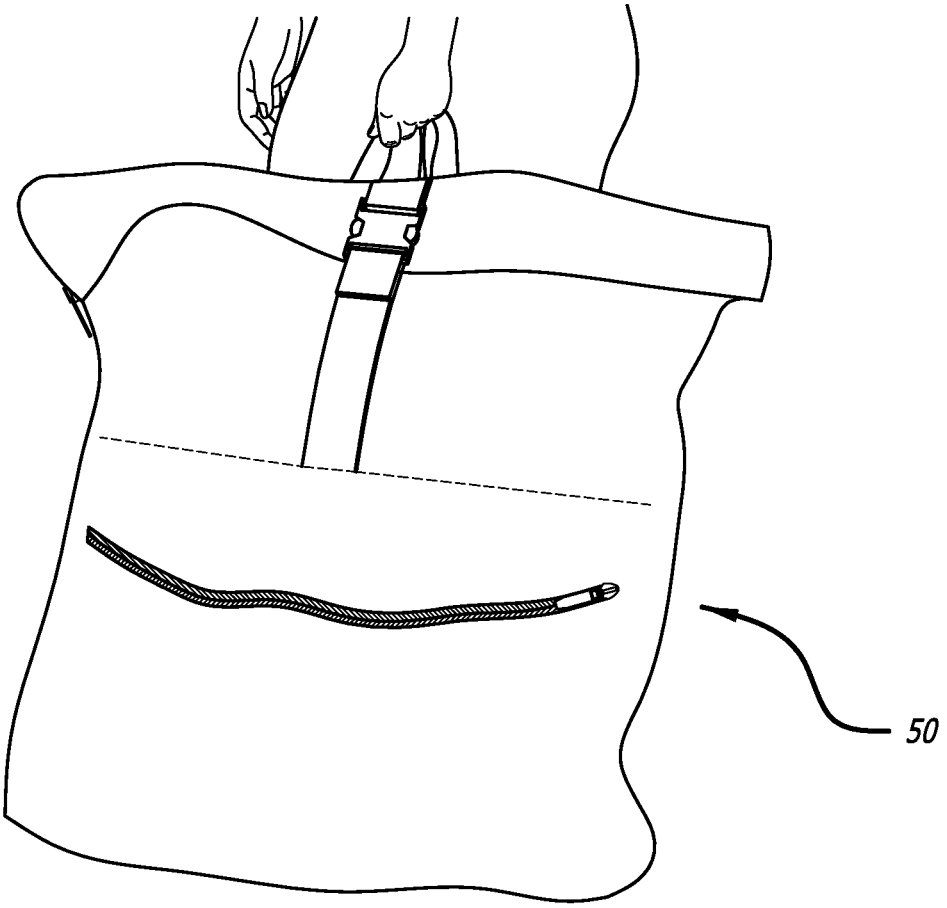
FIG. 9 is the entire canopy deflated and folded into a carrying bag.

FIG. 6 illustrates the canopy 10 in the deflated configuration. The inflatable arches 14 deflate to a flat, cross-shaped sheet that can easily be rolled up or folded up for storage in a carry bag 50 (FIG. 9). Since there are no poles or other rigid truss elements, the present invention is much more portable and lightweight compared with canopies with metal bars and can be carried in a small case or bag.

Figure 10:
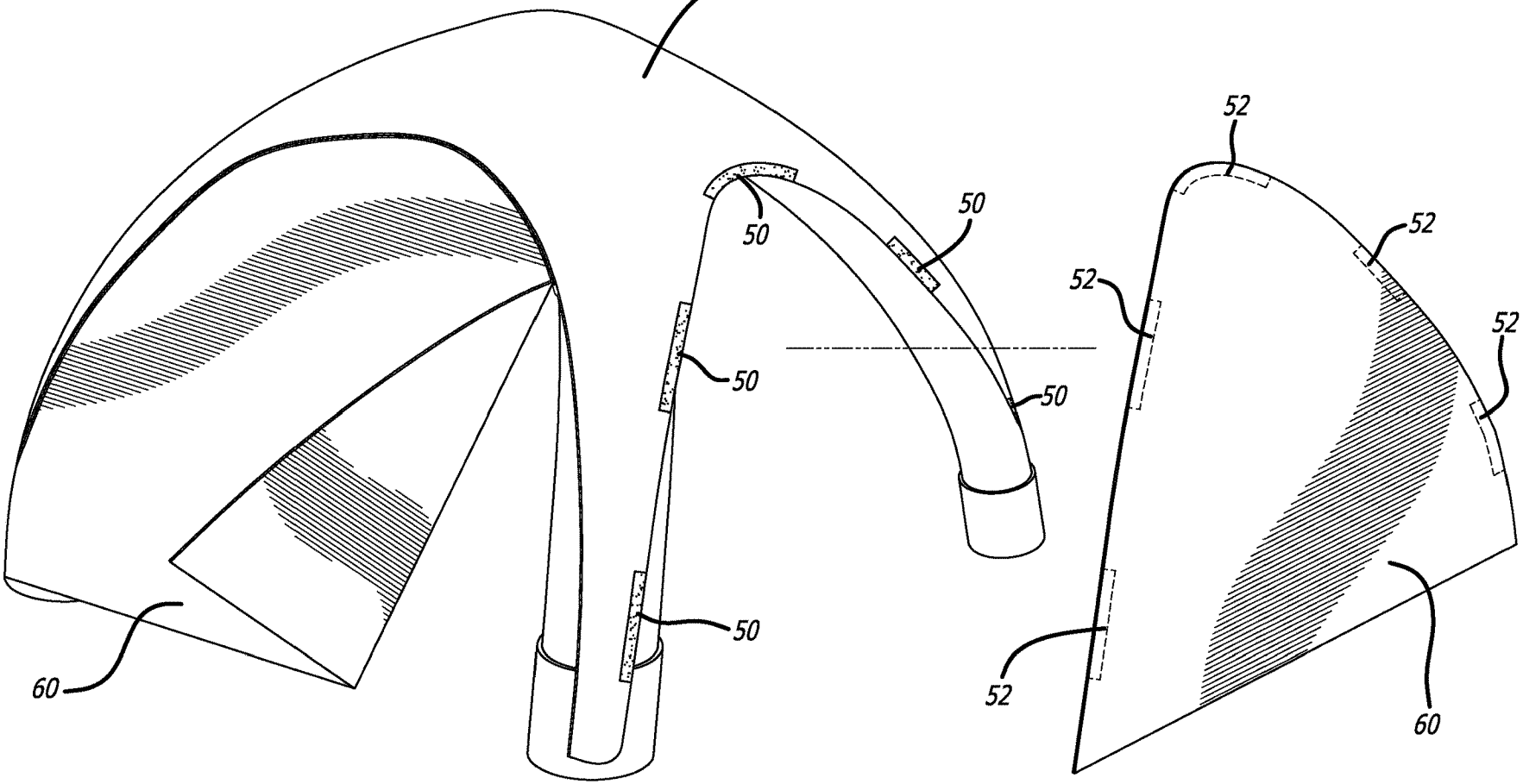
FIG. 10 is an elevated, perspective view of an alternate embodiment of the present invention with attachable coverings.

FIG. 10 illustrates another embodiment of the present invention wherein the canopy 10 of FIG. 2 includes zippers or hook and loop attachments 50 along the tarp's periphery that are used with mating zippers or hook and loop attachments 52 to releasably secure substantially parabolic panels 60 that enclose the canopy. The panels 60 are easily removed when needed by detaching the connections 50, 52, and can be used to further protect users from wind and/or rain. In a preferred embodiment, the panels 60 may be transparent to allow viewing from inside the canopy while keeping the elements from affecting the occupants.

Figure 11:
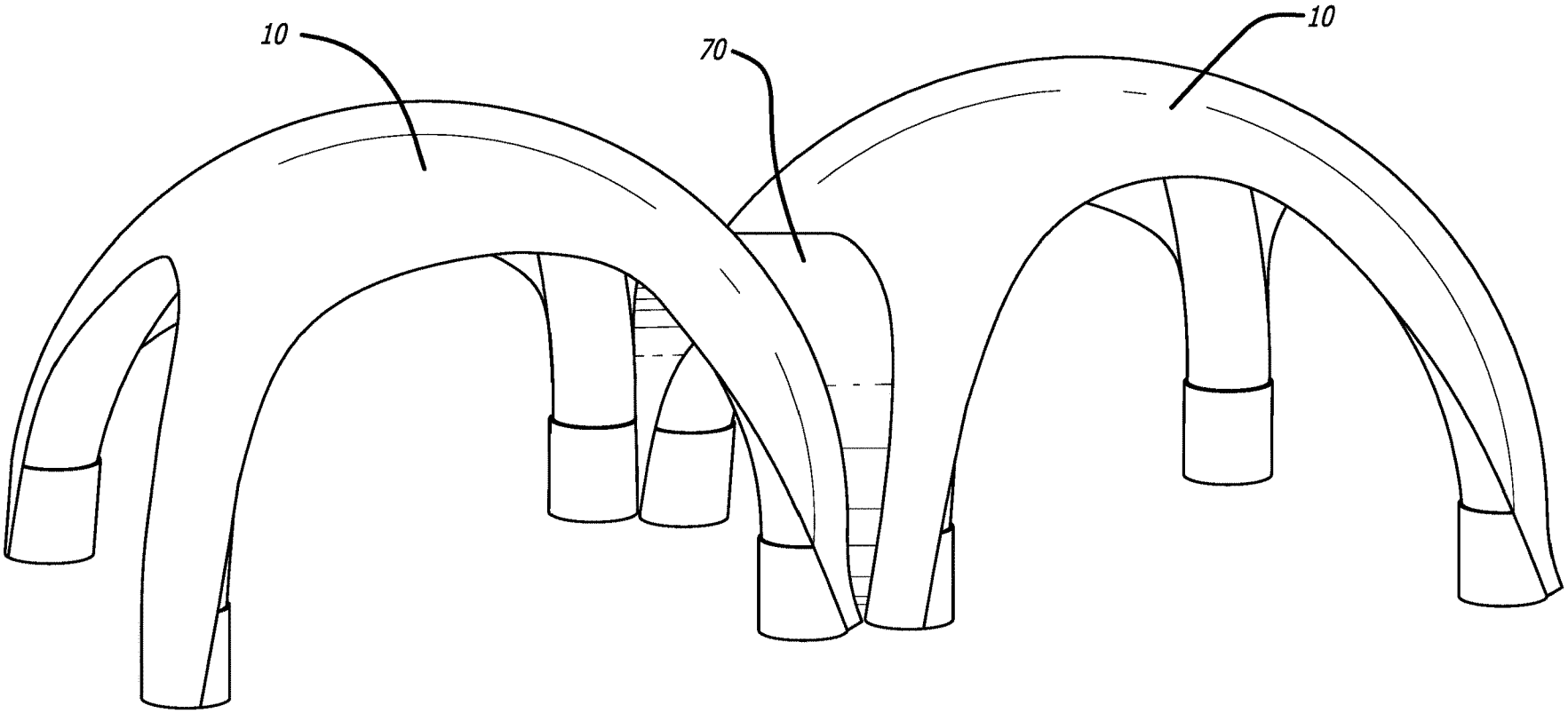
FIG. 11 is an elevated, perspective view of another embodiment of the present invention where adjacent canopies are coupled.
Figure 12:
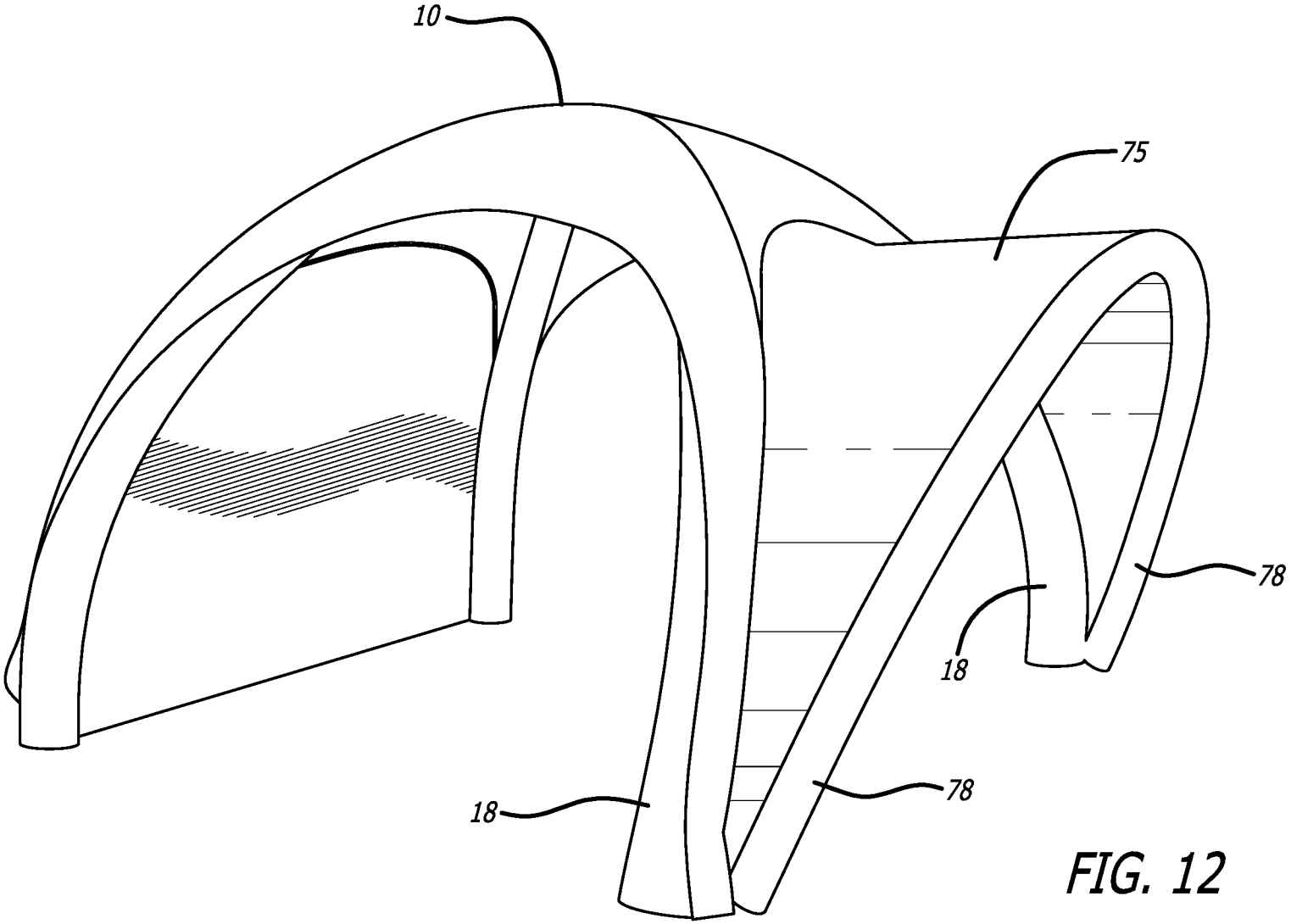
FIG. 12 is an elevated, perspective view of another embodiment of the present invention including a parabolic extension.

FIG. 11 illustrates yet another embodiment of the present invention, whereby two adjacent canopies 10 are joined by an archway 70 that connects the interior of the two canopies. The archway 70 can be connected by the attachments discussed above with respect to FIG. 10 and allow occupants to move between canopies without going outside. Alternatively, as shown in FIG. 12, the archway 75 can extend away from the canopy and form a shade/rain extension that increases the shelter's area. The archway 75 is shaped like an orange wedge and includes an arched support member 78 that is in fluid communication with the legs 18 of the arches and inflates with the arches 14 to extend and support the archway 75. The archway may be connected with zippers, hook and loop connectors, snaps, or any other releasable connections.

While the general features and benefits of the present invention have been described and depicted herein, it is to be understood that the scope of the present invention extends beyond those depictions and descriptions herein. A person of ordinary skill in the art would readily recognize and appreciate a number of modifications and substitution to the descriptions herein, and the scope of the invention is intended to include all such modifications and substitutions. Accordingly, unless expressly stated herein, no specific embodiment herein shall be deemed exclusive to the scope of the present invention.

We claim:

1. A portable, inflatable canopy, comprising:

first and second inflatable arches intersecting perpendicularly at a common apex to form a continuous fluidly connected structure, the fluidly connected structure having at least one inflation valve configured with a cylindrical, externally threaded rim;

a flexible covering attached to the fluidly connected structure and extending away from the fluidly connected structure to form a dome;

an archway extending from the dome to expand an area of shelter of the canopy, and wherein the archway is fluidly connected to the inflatable arches;

a battery powered fan adapted to inflate and deflate the fluidly connected structure; and a conical coupling configured to attach the battery powered fan to the inflation valve at the cylindrical threaded rim.

2. The portable, inflatable canopy of claim 1, wherein the conical coupling includes a slot for twist locking onto a pin of the battery powered fan.

3. The portable, inflatable canopy of claim 1, wherein the flexible covering is sewn onto the structure.

4. The portable, inflatable canopy of claim 1, further comprising a carry bag that receives the canopy in a deflated state.

5. The portable, inflatable canopy of claim 1, further comprising a closure element for sealing a valve on the canopy when the fan is not attached.

6. The portable, inflatable canopy of claim 1, further comprising at least one parabolic panels connectable to the flexible covering to enclose a portion of the canopy.

7. The portable, inflatable canopy of claim 1, wherein the archway is adapted to connect to a second canopy.

* * * * *